US006495006B1

(12) United States Patent
Kimura et al.

(10) Patent No.: US 6,495,006 B1
(45) Date of Patent: Dec. 17, 2002

(54) BIPOLAR ION EXCHANGE MEMBRANE ELECTROLYTIC CELL

(75) Inventors: Tatsuhito Kimura; Hajime Ishizaka; Kiyoshi Hachiya, all of Chiba (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 09/622,990

(22) PCT Filed: Dec. 24, 1999

(86) PCT No.: PCT/JP99/07283

§ 371 (c)(1),
(2), (4) Date: Aug. 25, 2000

(87) PCT Pub. No.: WO00/39365

PCT Pub. Date: Jul. 6, 2000

(30) Foreign Application Priority Data

Dec. 25, 1998 (JP) ..... 10/376482

(51) Int. Cl.[7] ..... C25D 3/60; C25D 3/06
(52) U.S. Cl. ..... 204/254; 204/288.3
(58) Field of Search ..... 204/254, 255, 204/288.3

(56) References Cited

U.S. PATENT DOCUMENTS

| | | | | |
|---|---|---|---|---|
| 3,872,437 A | | 3/1975 | Pulver | |
| 4,124,479 A | * | 11/1978 | Boulton | 204/256 |
| 4,425,214 A | * | 1/1984 | Pellegri | 204/254 |
| 4,444,639 A | * | 4/1984 | Schurig et al. | 204/257 |
| 4,519,888 A | * | 5/1985 | Akazawa et al. | 204/252 |
| 4,561,959 A | | 12/1985 | Pimlott | |
| 4,617,101 A | * | 10/1986 | Sato et al. | 204/252 |
| 4,923,582 A | * | 5/1990 | Abrahamson et al. | 204/255 |
| 5,360,526 A | * | 11/1994 | Arimoto et al. | 204/242 |
| 5,571,390 A | | 11/1996 | Kimura et al. | |
| 6,063,257 A | | 5/2000 | Kimura et al. | |

FOREIGN PATENT DOCUMENTS

| | | |
|---|---|---|
| JP | 57-200578 | 12/1982 |
| JP | 01-316482 | 12/1989 |
| JP | 08-100286 | 4/1996 |
| JP | 08-100287 | 4/1996 |

* cited by examiner

*Primary Examiner*—Donald R. Valentine
(74) *Attorney, Agent, or Firm*—Oblon, Spivak, McClelland, Maier & Neustadt, P.C.

(57) ABSTRACT

The present invention has an object of providing a bipolar type ion exchange electrolytic cell which is capable of minimizing the anode-cathode distance by a movable system which has a low electric resistance and which is simple and inexpensive, thereby to substantially reduce the electrolysis voltage. The present invention is a bipolar type ion exchange membrane electrolytic cell comprising an anode compartment frame which comprises an anode plate and an anode back plate arranged in substantially parallel with each other with a spacing, conductive anode supporting members arranged with a prescribed spacing from one another between the anode plate and the anode back plate, and a cathode compartment frame which comprises a cathode plate and a cathode back plate arranged in substantially parallel with each other with a spacing, and conductive cathode supporting members arranged with a prescribed spacing from one another between the cathode plate and the cathode back plate, so that the respective back plates are connected back to back to form a compartment frame unit, a plurality of such compartment frame units being arranged with a cation exchange membrane interposed, wherein at least the cathode supporting members comprise a flexible member, and the cathode plate is movably supported by the function of the flexible member.

18 Claims, 3 Drawing Sheets

BIPOLAR ION EXCHANGE MEMBRANE ELECTROLYTIC CELL

TECHNICAL FIELD

The present invention relates to a bipolar type ion exchange membrane electrolytic cell which is suitably useful for the production of e.g. an aqueous alkali metal hydroxide solution.

BACKGROUND ART

Heretofore, as an ion exchange membrane electrolytic cell to be used for e.g. production of an aqueous alkali metal hydroxide solution, a filter press type electrolytic cell has been used in many cases. This is one wherein a number of ion exchange membranes and compartment frame units each comprising an anode compartment frame and a cathode compartment frame, are alternately arranged and clamped from both sides by e.g. a hydraulic press. Types of electrolytic cells are generally classified into a monopolar type electrolytic cell (monopolar cell) of a parallel connection type and a bipolar type electrolytic cell (bipolar cell) of a series connection type, which are distinguishable by the difference in electrical connection.

As shown in FIGS. 1 and 2, in a compartment frame unit (general term for an anode compartment frame and a cathode compartment frame) for a bipolar type electrolytic cell, an anode compartment 15 and a cathode compartment 25 are arranged back to back, and an anode compartment frame 10 constituting the anode compartment 15, comprises an anode plate 30 and an anode back plate 40 arranged in substantially parallel with the anode plate with a spacing therefrom. As such an anode plate, it is common to employ a meshed or porous plate. For example, a conductive meshed plate of e.g. titanium, zirconium or tantalum is used as a substrate, and an oxide of a noble metal such as titanium oxide, ruthenium oxide or iridium oxide, is coated thereon.

Between the anode plate 30 and the anode back plate 40, corrosion resistant conductive anode supporting members (called also as ribs) 50*a* made of e.g. titanium or a titanium alloy, are arranged with a prescribed spacing from one another to electrically connect the two and to maintain the spacing therebetween. Each anode supporting member 50*a* may, for example, be made of a plate member and provided with a plurality of through-holes (not shown) so that an electrolyte can flow in the left and right directions in FIGS. 1 and 2.

The construction of the cathode compartment frame 20 for providing a cathode compartment 25 is the same as that of the anode compartment frame 10. Namely, it comprises a meshed or porous cathode plate 60, a cathode back plate 70 and cathode supporting members 80*a*.

Similarly, between the cathode plate 60 and the cathode back plate 70, corrosion resistant conductive cathode supporting members 80*a* made of e.g. iron, nickel or a nickel alloy, are arranged with a prescribed spacing from one another to electrically connect the two and to maintain the spacing therebetween, as shown e.g. in FIG. 1.

The anode back plate 40 and the cathode back plate 70 are integrally connected to form a partition wall 9. Between the anode back plate 40 and the cathode back plate 70 constituting the partition wall 9, a conductive interlayer member such as a cladding material (not shown) may be inserted in order to increase the electrical conductivity. A peripheral edge portion of each of the anode back plate 40 and the cathode back plate 70 constituting the partition wall, is bent and fixed to a hollow body 7 by e.g. welding. Reference numeral 11 indicates an ion exchange membrane, and numeral 12 a gasket. The cathode plate is preferably made of an alkali resistant material, such as a substrate made of e.g. a conductive meshed plate of e.g. nickel or stainless steel, coated with a cathode active material such as Raney nickel or a platinum series.

In a case where such a bipolar cell is used for electrolysis of an alkali metal halide such as sodium chloride to produce an alkali metal hydroxide, an almost saturated sodium chloride aqueous solution is supplied as an anolyte to an anode compartment from an anolyte inlet 3 which is usually provided at a lower portion of the anode compartment. In the anode compartment, chlorine gas is generated on the anode plate by electrolysis, and it will be discharged, together with the aqueous sodium chloride solution as the electrolyte, out of the anode compartment frame from an anolyte outlet 4 which is provided usually at an upper portion of the anode compartment.

On the other hand, in a cathode compartment, water or a dilute sodium hydroxide aqueous solution is supplied as a catholyte to the cathode compartment from a catholyte inlet 5 which is provided usually at a lower portion of the cathode compartment. In the cathode compartment, hydrogen gas and sodium hydroxide are formed and discharged out of the cathode compartment from a catholyte outlet 6 which is provided at an upper portion of the cathode compartment.

The role of an ion exchange membrane used for this sodium chloride electrolysis, is to let sodium ions pass from the anode compartment side to the cathode compartment side and to shut off movement of hydroxyl ions generated on the cathode side to the anode compartment side.

Usually the anode plate 30 is fixed to e.g. anode supporting members 50*a* in the anode compartment by e.g. welding. Likewise, the cathode plate 60 is also fixed to e.g. cathode supporting members 80*a* in the cathode compartment by e.g. welding, and the anode plate 30 and the cathode plate 60 are clamped with an ion exchange membrane interposed via gaskets 12 so that they maintain a prescribed distance. In general, the distance between the anode plate and the cathode plate (the anode-cathode distance) is a factor giving a substantial influence over the electrolysis voltage of the electrolytic cell. As a matter of course, the shorter the anode-cathode distance, the lower the electrolysis voltage, so that the electric power can be saved. On the other hand, if the anode and the cathode are too close to each other, the electrode plates are likely to contact with the membrane, since the membrane itself is flexible, and its position in the electrolyte is not completely fixed. In such a case, as numerous fine irregularities or projections are present on the surface of the electrode plates, if the membrane moves in frictional contact with the electrode plate surface in such a state that these irregularities or projections are forcibly pressed against the membrane, the membrane is likely to be forcibly cut.

If a substantial portion of the membrane is thus damaged, normal operation of the electrolytic cell tends to be finally impossible. Accordingly, heretofore, the operation is obliged to be carried out on a safe side by increasing the anode-cathode distance to such an extent where there will be no possibility of damaging the membrane, even if the electrolysis voltage is sacrificed to some extent.

Some attempts have been proposed in the past not to give a damage to an ion exchange membrane even if the membrane is disposed as close as possible to an anode plate or a cathode plate having such fine irregularities or projections. For example, JP-A-57-108278 discloses a technique wherein a number of conductive spring members are provided between an electrode plate and a partition plate on the anode side and/or the cathode side to make the electrode plate movable. Further, JP-A-1-55392 discloses a technique wherein a partition plate and an electrode plate are electrically connected by a clamp spring mechanism, and at the same time, the electrode plate is made movable by the resilience of the clamp spring mechanism.

These are techniques whereby even if the electrode plate and a membrane are in contact with each other, the pressing pressure can be reduced, but each employs a movable mechanism by springs, whereby there has been a problem such that (1) the electrical resistance at the spring member portions increases, or (2) the production costs tend to increase because of the. complexity in the structure of the spring mechanism. (3) A more serious problem is that since a movable mechanism whereby the spacing between the electrode and the partition wall is maintained solely by the spring members having resiliency, even if it is possible to make the electrode plate movable, it is necessarily impossible from its mechanism to maintain the anode-cathode distance which must be uniformly maintained over the entire electrolytic surface. Therefore, even if it is possible on appearance to reduce the anode-cathode distance by the movable mechanism, in reality, it is impossible to maintain the uniformity of the anode-cathode distance during a steady operation, and from the overall viewpoint, it has been impossible to effectively reduce the electrolysis voltage.

DISCLOSURE OF THE INVENTION

It is an object of the present invention to solve such problems and to provide a bipolar type ion exchange electrolytic cell which is capable of reducing the electrolysis voltage substantially by minimizing the anode-cathode distance by a simple and inexpensive movable mechanism having a low electrical resistance. Further, it is an object of the present invention to provide a bipolar type ion exchange electrolytic cell whereby even if the spacing between the electrode plate and the ion exchange membrane is made to be from 0.1 to 1.0 mm, there will be no danger of damage to the membrane.

Firstly, the present invention provides the following invention.

A bipolar type ion exchange membrane electrolytic cell comprising an anode compartment frame which comprises an anode plate and an anode back plate arranged in substantially parallel with each other with a spacing, conductive anode supporting members arranged with a prescribed spacing from one another between the anode plate and the anode back plate, and a cathode compartment frame which comprises a cathode plate and a cathode back plate arranged in substantially parallel with each other with a spacing, and conductive cathode supporting members arranged with a prescribed spacing from one another between the cathode plate and the cathode back plate, so that the respective back plates are connected back to back to form a compartment frame unit, a plurality of such compartment frame units being arranged with a cation exchange membrane interposed, wherein (a) at least the cathode supporting members comprise electric current supply rib base portions fixed to the cathode back plate and standing up towards the cathode plate, and a flexible member supported by the adjacent electric current supply rib base portions and extending to reach the cathode plate, (b) the flexible member and the cathode plate are electrically connected to each other via a connecting portion of the flexible member, and (c) electric current supply from the cathode plate to the electric current supply rib base portions is carried out through the connecting portion, and the cathode plate is movably supported by the function of the flexible member.

Secondly, the present invention provides the following invention.

A bipolar type ion exchange membrane electrolytic cell comprising an anode compartment frame which comprises an anode plate and an anode back plate arranged in substantially parallel with each other with a spacing, conductive anode supporting members arranged with a prescribed spacing from one another between the anode plate and the anode back plate, and a cathode compartment frame which comprises a cathode plate and a cathode back plate arranged in substantially parallel with each other with a spacing, and conductive cathode supporting members arranged with a prescribed spacing from one another between the cathode plate and the cathode back plate, so that the respective back plates are connected back to back to form a compartment frame unit, a plurality of such compartment frame units being arranged with a cation exchange membrane interposed, wherein (a) at least the anode supporting members comprise electric current supply rib base portions fixed to the anode back plate and standing up towards the anode plate, and a flexible member supported by the adjacent electric current supply rib base portions and extending to reach the anode plate, (b) the flexible member and the anode plate are electrically connected to each other via a connecting portion of the flexible member, and (c) electric current supply from the electric current supply rib base portions to the anode is carried out through the connecting portion, and the anode plate is movably supported by the function of the flexible member.

EXPLANATIONS OF SYMBOLS

Figure 1:
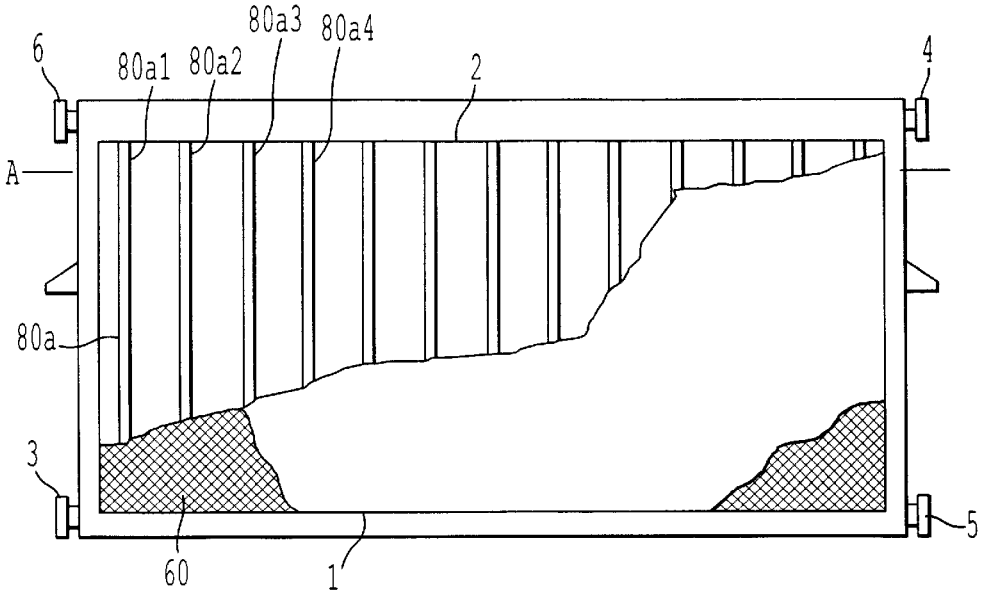
FIG. 1 is a front view of a compartment frame unit of a bipolar type ion exchange membrane electrolytic cell to carry out the present invention, as observed from a cathode compartment frame.

1 a lower portion of a compartment frame
2 an upper portion of the compartment frame

3 an anolyte inlet
4 an anolyte outlet
5 a catholyte inlet
6 a catholyte outlet
7 a hollow body
9 a partition wall for a bipolar electrolytic cell
10 an anode compartment frame
11 an ion exchange membrane
12 a gasket
15 an anode compartment
20 a cathode compartment frame
25 a cathode compartment
30 an anode plate
40 an anode back plate
50*a* an anode supporting member (rib)
60 a cathode plate
70 a cathode back plate
80*a* a cathode supporting member (rib)
90 a cathode back plate or a partition wall plate
95 a cathode plate
97 an anode
99 an anode back plate or a partition wall plate
100 a cation exchange membrane
101, 101' an electric current supply rib base portion
102 a connecting portion (a supporting portion) of a flexible member and an electric current supply rib base portion
103, 103' a flexible member or a flexible plate metal
105, 105' a connecting portion on the flexible member
109, 109' a protrusion of the flexible plate metal
110' an anode supporting member (M type electric current supply rib) on the anode side
113' a shoulder portion of the M type electric current supply rib
120 a M type electric current supply rib on the cathode side
123 a shoulder portion of the M type electric current supply rib on the cathode side
130 a M type electric current supply rib on the anode side
133 a shoulder portion of the M type rib on the anode side
201 a spacer formed of a non-conductive material
205 a plate metal chip
p,p' an apex of the protrusion
A1, A1' the width of the flexible plate metal
A2, A2' a spacing between the cathode plate and the portion of the plate metal other than the protrusion (the height of the protrusion)
A3, A3' the height of the electric current supply rib base portion
A4 the width of the M type rib
A5 a spacing between the cathode plate and the fixed electric current supply rib base portion
Vd a closed space formed between the plate metal and the partition wall plate
Vu a space between the plate metal and the cathode plate

BEST MODE FOR CARRYING OUT THE INVENTION

Now, the present invention will be described in detail with reference to the drawings.

Figure 2:
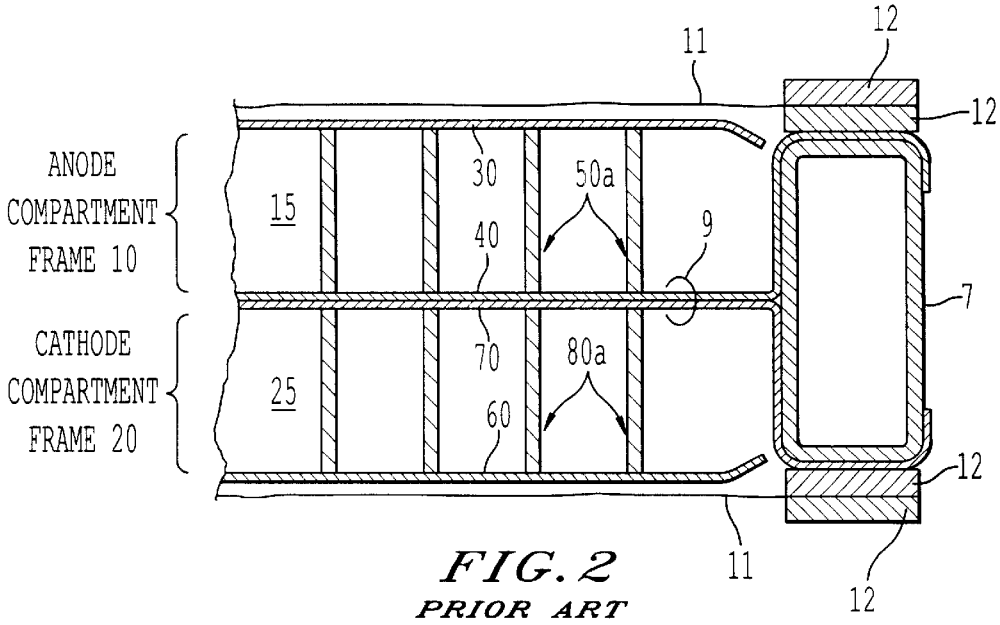
FIG. 2 PRIOR ART
FIG. 2 is a view showing the cross section of the compartment frame unit along line A—A in FIG. 1 together with ion exchange membranes and gaskets, and represents a conventional case having no movable mechanism in a cathode compartment.
Figure 3:
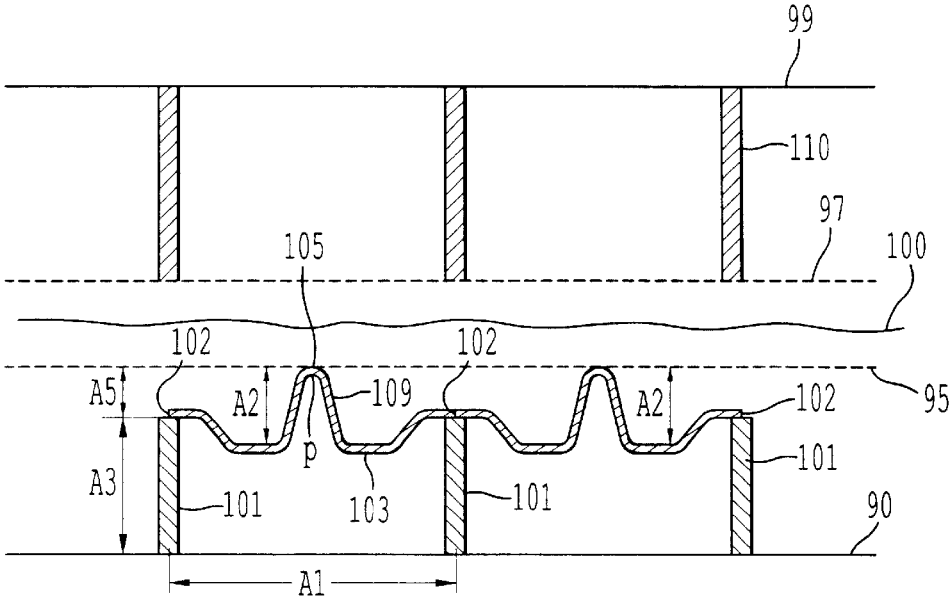
FIG. 3 is a partially cross-sectional diagrammatical view of a compartment frame unit illustrating a typical embodiment of the present invention.

The electrolytic cell to which the present invention is applicable, may be of a monopolar type or a bipolar type. However, it is preferably a bipolar type ion exchange membrane electrolytic cell and is basically a bipolar type ion exchange membrane electrolytic cell comprising, as shown in FIG. 2, an anode compartment frame which comprises an anode plate and an anode back plate arranged in substantially parallel with each other with a spacing, conductive anode supporting members arranged with a prescribed spacing from one another between the anode plate and the anode back plate, and a cathode compartment frame which comprises a cathode plate and a cathode back plate arranged in substantially parallel with each other with a spacing, and conductive cathode supporting members arranged with a prescribed spacing from one another between the cathode plate and the cathode back plate, so that the respective back plates are connected back to back to form a compartment frame unit, a plurality of such compartment frame units being arranged with a cation exchange membrane interposed. And, as shown in FIG. 3, the basic embodiment is such that (a) at least the cathode supporting members comprise electric current supply rib base portions 101 fixed to the cathode back plate 90 and standing up towards the cathode plate 95, and a flexible member 103 supported by the adjacent electric current supply rib base portions 101 and extending to reach the cathode plate. Further, 102 indicates a connecting portion of the flexible member and the electric current supply rib base portion, and this is also a supporting portion at which the flexible member is supported by the electric current supply rib base portion.

And, (b) the flexible member extending to the cathode plate and the cathode plate are electrically connected to each other via a connecting portion 105 of the flexible member. (c) Through this connecting portion 105, an electric current flows from the cathode plate 95 to the electric current supply rib base portions 101, and the above connecting portion is also a mechanical connecting point for transmission of a force, whereby when an external force is exerted to the cathode plate, for example, by generation of a gas in the cathode compartment, the above flexible member 103 may move for example, in a vertical direction to the cathode plate, with the connecting portion 105 as the starting point, so that the cathode plate is displaced to protect the ion exchange membrane from damage. Here, when the flexible member 103 moves, the supporting portions 102 and 102 will be fulcrums for the movement.

The present invention is thus characterized in that the cathode supporting members comprise electric current supply rib base portions fixed to the cathode back plate and standing up towards the cathode plate, and a flexible member supported by the adjacent electric current supply rib base portions and extending to reach the cathode plate.

Namely, by this construction, the heights (A3) of base portions of the fixed electric current supply rib base portions are constant, whereby it is possible to protect the cation exchange membrane by changing the anode-cathode distance in the minimum range required not to damage the membrane by slightly displacing only the flexible member (the spacing A5 between the cathode plate 95 and the fixed electric current supply rib base portions 101) supported by this base portions depending upon the change of the external force, while maintaining the anode-cathode distance basically at a constant value.

The flexible member extends in its upper and lower directions to the upper and lower ends of the electrolysis area, and an appropriate clearance such as an opening or a cut edge is preferably provided at its upper and lower ends.

A more specific embodiment of the flexible member of the present invention is shown in FIG. 3 wherein the flexible member 103 is made of a flexible plate metal 103 having at least one protrusion 109 formed substantially at its center, and the apex p of this protrusion constitutes the above-mentioned connecting portion 105.

The flexible plate metal 103 preferably has a plate thickness of from 0.1 to 1.0 mm, its width A1 is from 4 to 25 cm, and the spacing A2 between the cathode plate and the portion of the plate metal other than the protrusion 109 (in other words, the height of the protrusion) is from 3 to 30 mm. The flexible plate metal is selected from e.g. plate-shaped soft steel, stainless steel, nickel and nickel alloys, and copper and copper alloys, and such a metal is used by processing it to have the above-mentioned shape.

On the assumption that a flexible plate metal as such a flexible member is installed in a cathode compartment in FIG. 1 showing a front view of a compartment frame of a bipolar type ion exchange membrane electrolytic cell, as observed from a cathode compartment frame, in the present invention, cathode supporting members 80*a* in the Figure correspond to the electric current supply rib base portions 101, and the flexible plate metal is supported by the adjacent electric current supply rib base portions, respectively, i.e. it is installed between 80*a*1 and 80*a*2, 80*a*2 and 80*a*3, 80*a*3 and 80*a*4, . . . , respectively. Namely, the flexible plate metal is installed to extend substantially over the entire area in the cathode compartment. The cathode plate 60 in the Figure is electrically and mechanically connected to this flexible plate metal, and the cathode plate is designed to be movable substantially uniformly in the direction of the anode plate (the rear side of the sheet surface) over the entire electrolysis area in the Figure. Namely, when the cathode plate is contacted to the cation exchange membrane present on the front side of the sheet surface, the flexible plate metal will move in the direction of the anode plate (on the rear side of the paper sheet) by the pressing pressure to displace the cathode plate to reduce the pressing pressure, so that the membrane will not be damaged. Further, by permitting the flexible metal to have sufficient resiliency, the membrane may be strongly clamped between the cathode plate and the conventional fixed anode plate facing via a cation exchange membrane, whereby the membrane will be free from being damaged.

Thus, in the electrolytic cell of the present invention, the entire area of the cathode plate can be brought uniformly close to the cation exchange membrane, whereby the anode-cathode distance can be shortened, and the electrolysis voltage can substantially be reduced.

As described in the foregoing, in a preferred embodiment of the present invention, the spacing between the cathode plate and the cation exchange membrane can be set even in a very small range of from 0.1 to 2.0 mm, preferably from 0.1 to 1.0 mm.

In the present invention, the spacing between the cathode plate and the cation exchange membrane can be adjusted by changing the thickness of the gasket 12 installed along the periphery of the compartment frame or by changing the height A2 of the protrusion 109 of the plate metal.

The material for the flexible plate metal to be used in the present invention, can be selected by the formula (1).

$$\delta(\text{mm})=K\times P(\text{kg/cm}^2) \quad (1)$$

wherein δ is the movable degree (mm) of the flexible plate metal, K is a constant determined by the material and the shape of the metal, and P is the pressure (kg/cm$^2$) exerted to the protrusion of the flexible plate metal.

Here, δ is the movable degree when the protrusion receives pressure P of e.g. pressing pressure, more accurately, the movable degree within the resiliency, and with a flexible metal made of a prescribed metal material and having a certain shape, on the basis of an assumed pressure, the movable degree under the pressure can be calculated. As a matter of course, one having a larger value of the constant K, for example, one having higher softness and flexibility, is readily movable simply when it receives a slight pressure P.

In the present invention, the movable degree of the cathode plate is preferably at most 10 mm. Accordingly, the optimum value can be determined by carrying out simulation by means of the formula (1) by variously changing factors such as (1) selection of the type of the metal material, (2) selection of the shape such as the plate thickness, the width A1 and the height A2 of the protrusion, so that the movable degree of the flexible plate metal will be from 0 to 10 mm.

In the present invention, the value of K is preferably within a range of from 0.2 to 200, more preferably within a range of from 4 to 40.

Figure 4:
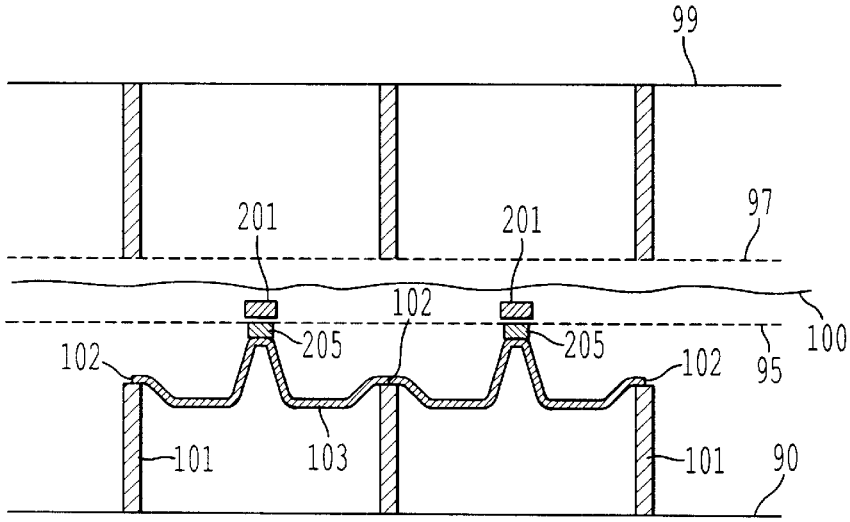
FIG. 4 is a partially cross-sectional diagrammatical view of a compartment frame unit illustrating a case wherein conductive plate metal chips and non-conductive spacers are provided.

In the present invention, a non-conductive spacer may be interposed between the anode plate and the cation exchange membrane, so that the two will not be in direct contact with each other even when the spacing between the cathode plate and the membrane is very small. FIG. 4 illustrates this state, wherein 201 represents a spacer formed of a non-conductive material.

As the spacer, basically any material may be employed so long as it is non-conductive. However, preferably, it is a non-conductive resin or rubber (namely, an elastic body or an elastomer). Such a resin is not particularly limited, and it is, for example, polypropylene or polytetrafluoroethylene (PTFE), and the rubber may, for example, be butyl rubber or an ethylene-propylene-diene rubber (EPDM). The resin or rubber may be a porous body or a foamed body. These may be used in a suitable form such as a plate-form, a sheet-form, a film-form, a fiber-form or a spherical form. Spacers 201 of such a form are to be disposed basically between the cathode plate and the cation exchange membrane. More specifically, it is most preferred to dispose them respectively above the apexes (the forward ends) p of protrusions of the flexible plate metal. However, they may be disposed, respectively, between protrusions. In either case, the spacers thus disposed, will be provided above or in between the cathode supporting plates 80*a*1, 80*a*2, 80*a*3, . . . which correspond to the electric current supply rib base portions in FIG. 1. Further, the spacers are preferably disposed with a proper spacing in the upper or lower direction of the compartment frame and linearly provided.

The spacer may be one formed of e.g. a resin having a hardness of from D40 to D80 (D scale test method according to ASTM D2240), or one formed of a rubber softer than the hardness of the membrane.

Here, spacers made of e.g. rubber are employed to prevent deformation of the membrane by creep. Namely, for example, when the cathode plate is pressed against the cation exchange membrane with non-conductive spacers interposed therebetween, the two are not in direct contact with each other by the presence of the spacers. However, if the operation is carried out for a long period of time in a state where the pressing pressure is too strong, the membrane itself is likely to undergo creep deformation due to the pressing pressure, and the polymer in the interior of the membrane at the deformed portion is likely to undergo chemical deterioration, and finally, pinholes may be formed in the membrane.

In such a case, if spacers made of non-conductive rubber or elastomer softer than the hardness of the membrane, are employed, even if the above-mentioned pressing pressure results, the spacers themselves will serve as a cushion material and will suitably be deformed, so that the pressing pressure can readily be reduced, and the creep deformation of the membrane can effectively be prevented.

The thickness of the spacer is preferably from 0.1 to 1.0 mm. When spacers having a hardness of D40 to D80 are installed, the spacing between the ion exchange membrane and the cathode plate corresponding to the thickness will be maintained even during the operation. Whereas, with spacers made of an elastic body softer than the hardness of the membrane, the distance between the membrane and the cathode plate can be maintained with a spacing slightly thinner than the thickness of the spacer, during the operation.

Further, in the present invention, preferably, the connection between the cathode plate 95 and the connecting portion 105 at the apex p of the protrusion, is carried out via a plate metal chip 205 inserted and fixed i.e. interposed between the two.

This plate metal chip 205 is made of e.g. soft stainless steel, nickel or copper and fixed to the cathode plate and the connecting portion at the apex of the protrusion by means of e.g. welding to protect the connecting portion.

Namely, when the electrolytic cell is operated for a long period of time, the cathode performance decreases, and it becomes necessary every a few year to dismount the cathode plate from the electrolytic cell and mount a fresh cathode plate. If the cathode plate and the apex of the protrusion of the flexible plate metal are directly bonded by e.g. welding, the apex (the forward end portion) of the plate metal is susceptible to mechanical damage such as breakage or cracking from this portion even with a small force, since it is shape-wise a weak portion particularly in mechanical strength, during an operation to cut off the cathode plate from the flexible plate metal. In such a case, it becomes necessary to replace the flexible plate metal itself. By interposing the plate metal chip between the cathode plate and the connecting portion at the apex of the protrusion, the force exerted at the time of cutting off the cathode plate from the flexible plate metal will be concentrated directly on the plate metal chip and will not be exerted to the apex of the plate metal, whereby there will be no substantial possibility that the apex of the protrusion of the flexible plate metal will receive a damage.

The thickness of the plate metal chip is preferably from 0.5 to 3.0 mm. Further, with respect to the width, it is preferred that one having a width of from 3 to 15 mm is arranged in the up and down direction of the compartment frame, and it has a length of at least ½ of the height in the up and down direction of the compartment frame in consideration of the electric current distribution on the cathode plate.

Figure 5:
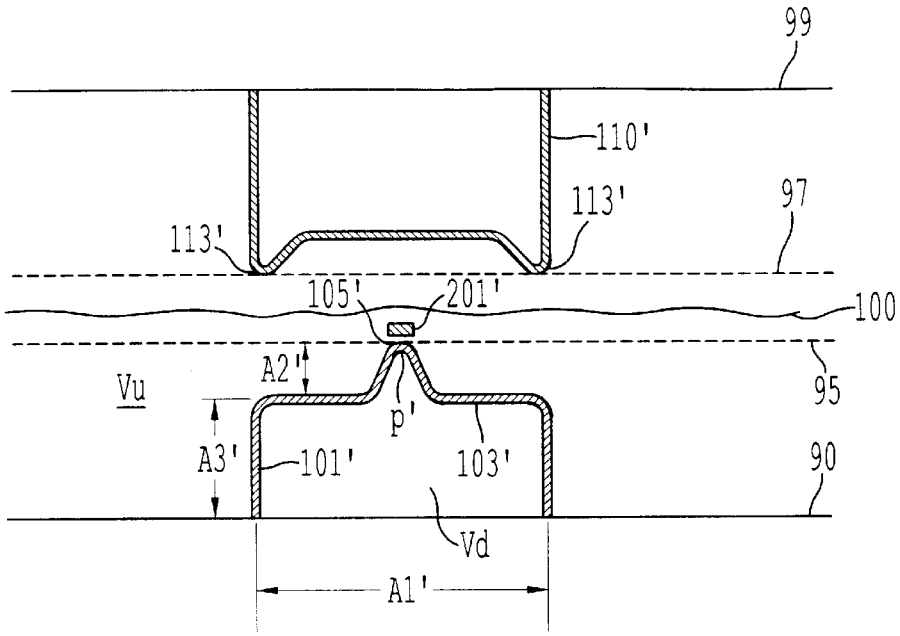
FIG. 5 is a partially cross-sectional diagrammatical view of a compartment frame unit illustrating another embodiment of the present invention.

FIG. 5 shows another embodiment of the present invention. Namely, this is a case wherein an electric current supply rib base portion 101' and a flexible member 103' are integrally formed by e.g. mold processing.

More specifically, the electric current supply rib base portion 101' and the flexible plate metal 103' are integrally formed in a cross-sectional ⊔ shape by e.g. mold processing, and this flexible plate metal 103' is electrically connected to the cathode back plate (partition plate) 90 by e.g. welding so that it forms a closed space together with the cathode back plate.

This flexible plate metal 103' is electrically and mechanically connected to the cathode plate 95 with the apex p' of a substantially center protrusion 109' constituting a connecting portion 105', and it has mobility similar to the plate member 103 shown in FIG. 3, and with the protrusion 109', the cathode plate 95 can be brought to be sufficiently close to the cation exchange membrane without damaging the membrane.

In such integral formation, it is preferred that the portion corresponding to the electric current supply rib base portion is formed to have a thicker cross section in order to increase the rigidity thereby to secure the fixing function, and the portion corresponding to the flexible plate metal is made to have a thin plate thickness thereby to secure flexibility.

The thickness of this flexible plate metal, the width A1' and the spacing (the height of protrusion) A2' between the cathode plate and the plate metal, can be handled in the same manner as the numerical values for the thickness of the flexible plate metal 103, the width A1 and the spacing A2 between the cathode plate and the plate metal, in FIG. 3.

In this embodiment, the plate metal 103' may be made to have simultaneously a downcomer function to promote the circulation of the electrolyte in the compartment frame. Namely, an opening or a cut edge for circulation of the electrolyte is provided at each of the upper portion and the lower portion of the compartment frame of the plate metal 103', so that a closed space Vd formed between the plate metal 103' and the partition plate 90 constitutes a down flow pathway for the down flow of the liquid. On the other hand, a space Vu between the plate metal 103' and the cathode plate 95 constitutes an up flow pathway for the liquid and gas. The two are connected via the above-mentioned opening or cut edge to form a continuous circulation flow pathway.

On the other hand, the corresponding anode side anode supporting member (electric current supply rib) 110' has a cross section of M shape, and the M-type electric current supply rib 110' is electrically secured to the anode back plate by e.g. welding so as to form a closed space together with the anode back plate (partition plate) 99. Further, the M-type electric current supply rib 110 is fixed at both side shoulders 113' to the anode 97 by e.g. welding, to form an anode compartment.

Figure 6:
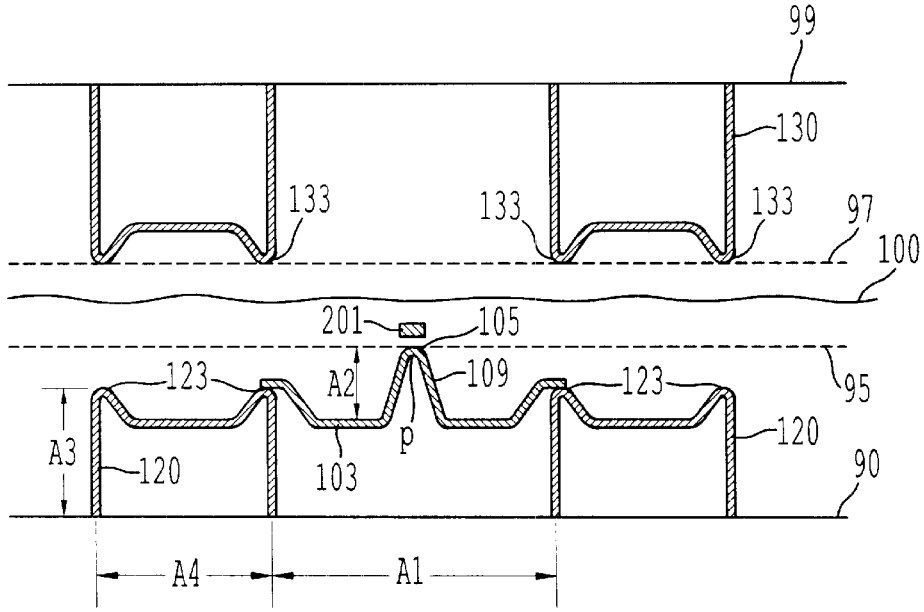
FIG. 6 is a partially cross-sectional diagrammatical view of a compartment frame unit illustrating another embodiment of the present invention.

FIG. 6 shows a still another embodiment of the present invention. An electric current supply rib 120 on the cathode side is one having a cross section of M shape, and this M-type electric current supply rib is electrically fixed to the partition plate 90 by e.g. welding to form a closed space together with the partition plate.

The flexible plate metal 103 is supported by adjacent electric current supply ribs. In such a case, it is fixed by e.g. welding at the opposing shoulders 123 of the adjacent M-type electric current supply ribs. The manner in which the flexible plate metal 103 is electrically and mechanically connected to the cathode plate 95 via a connecting portion 105 constituted by the apex p of the protrusion 109 at a substantially center portion, is the same as described with respect to FIGS. 3 and 4.

Further, the thickness of this plate metal, the width A1 and the spacing (the height of the protrusion) A2 between the cathode plate and the plate metal, can be handled in the same manner as the numerical values for the thickness of the flexible plate metal 103, the width A1 and the spacing A2 between the cathode plate and the plate metal, in FIG. 3. Further, the width A4 of the M-type electric current supply rib is preferably from about 50 to 70 mm.

On the other hand, on the anode side, a similarly M-type electric current supply rib 130 is disposed to face the electric current supply rib 120 on the cathode side via a cation exchange membrane 100, and as already described with respect to FIG. 5, the M-type electric current supply rib 130 is electrically fixed to the anode back plate 99 by e.g. welding so as to form a closed space together with the anode back plate (the partition plate), and further, the M-type electric current supply rib 130 is fixed to the anode 97 by e.g. welding at the both side shoulders 133, to form an anode compartment.

In the foregoing description, reference is made to a case wherein the cathode supporting members comprise electric current supply rib base portions fixed to the cathode back plate and standing up towards the cathode plate, and a flexible member supported by the adjacent electric current supply rib base portions and extending to reach the cathode plate. However, as is readily understood, the anode supporting members may, of course, comprise electric current supply rib base portions fixed to the anode back plate and standing up towards the anode plate, and a flexible member supported by the adjacent electric current supply rib base portions and extending to reach the anode plate. In such a case, in the forgoing description, the cathode supporting members constituting a flexible member may be read as the anode supporting members, and the cathode plate to which the flexible member is to be connected, may be read as the anode plate. Therefore, detailed description will be omitted.

Now, the present invention will be described in further detail with reference to Examples, but the technical scope of the present invention is by no means limited thereto.

EXAMPLE 1

Each of the anode and the cathode had a size such that the height was 1200 mm, the width was 2400 mm and the effective electrolytic area was 2.88 $m^2$. For the anode, DSE (an expanded mesh having a plate thickness of 1.5 mm) manufactured by Permelek Electrode Co., Ltd., was used. For the cathode, a nickel expanded mesh having a plate thickness of 1.2 mm was used as the substrate, and an activated Raney nickel alloy was coated thereon. For the anode back plate, a plate made of titanium was used, and for the cathode back plate, a plate made of nickel was used. These back plates were welded and bonded to each other to form the partition plate.

For the electric current supply rib on the anode side, a titanium plate having a thickness of 2.0 mm and a width of 35 mm was used. Eighteen electric current supply ribs were welded and fixed to the back plate and the anode with an equal spacing in the height direction of the compartment frame, to form an anode compartment. Further, for the electric current supply rib on the cathode side, a nickel plate having a thickness of 1.0 mm and a width of 30 mm was used, and eighteen electric current supply ribs were fixed to the back plate by welding with an equal spacing in the height direction of the compartment frame.

And, as shown in FIG. 3, as the flexible plate metal 103 having a protrusion at the center, a nickel plate was employed which was processed so that with the plate thickness of 0.5 mm, the width A1 was 140 mm, the height A2 of the protrusion 109 was 10 mm, and the spacing A5 between the cathode plate 95 and the fixed electric current supply rib base portions 101, was 4 mm. Both ends of this plate metal were attached to the cathode electric current supply ribs by welding, and the apex p of the protrusion was attached as the connecting portion 105 to the cathode plate likewise by welding, to form a cathode compartment frame. Such compartment frame units comprising an anode compartment and a cathode compartment, and cation exchange membranes, are alternatively arranged with a gasket 12 interposed, as shown in FIG. 2 and clamped from both sides by a clamping means made of iron so that the distance between the membrane and the cathode plate became 1 mm, and the movable degree of the flexible plate metal was 2 mm at the maximum, to assemble a bipolar type ion exchange membrane electrolytic cell. Further, for the ion exchange membranes, Flemion F893 (registered trademark of Asahi Glass Company, Limited) was used.

Into the anode compartments, an aqueous sodium chloride solution of 300 g/l was supplied from a lower portion of the compartment frames, so that the sodium chloride concentration at the outlet became 210 g/l, and into the cathode compartments, a dilute sodium hydroxide aqueous solution was supplied from a lower portion of the compartment frames, so that the concentration of the sodium hydroxide aqueous solution at the outlet became 32 wt %.

Electrolysis tests were carried out at an electrolytic temperature of 90° C. under a current density of 6 $kA/m^2$. As a result, the electrolysis voltage was 3.25 V.

EXAMPLE 2

Each of the anode and the cathode had a size such that the height was 1200 mm, the width was 2400 mm and the effective electrolytic area was 2.88 $m^2$. For the anode, DSE (an expanded mesh having a plate thickness of 1.5 mm) manufactured by Permelek Electrode Co., Ltd., was used. For the cathode, one having an activated Raney nickel alloy coated on a nickel expanded mesh having a plate thickness of 1.2 mm, was used. For the anode back plate, a plate made of titanium was used, and for the cathode back plate, a plate made of nickel was used. These back plates were bonded by welding to form a partition plate.

As shown in FIG. 5, on the cathode compartment side, a flexible plate metal 103' made of nickel and having a protrusion at the center portion was attached by welding to the cathode back plate 90 in the height direction of the compartment frame. 12 Plate metals 103' each having a thickness of 0.5 mm, a width A2' of 160 mm, a spacing A2 between the cathode plate 95 and the plate metal 103' being 10 mm and a height from the back plate 90 to the apex p' of the protrusion being 40 mm, were arranged with equal spacing on the electrolysis area. The cathode plate was bonded and fixed to the plate metals 103' by welding with the apex of the protrusion 109' of each plate metal being a connecting portion 105'.

A spacer 201' formed of a PTFE resin and having a thickness of 0.5 mm, a width of 10 mm and a length of 1150 mm, was disposed at a position corresponding to the apex p' (i.e. the connecting portion 105') of this protrusion, between the cation exchange membrane 100 and the cathode plate 95.

On the other hand, on the anode compartment side, as shown in FIG. 5, a titanium electric current supply rib 110' molded to have a M shape, was attached to the anode back plate 99 by welding. This M-type electric current supply rib 110' was one which had a plate thickness of 2.0 mm, a width of 160 mm and a height from the anode back plate 99 to the forward ends of the shoulder portions 113' of the M-type electric current supply rib being 35 mm, and it was welded and fixed to the anode plate 97 at the forward ends of the shoulder portions.

Such compartment frame units each comprising an anode compartment and a cathode compartment, and cation exchange membranes, are alternately arranged with gaskets 12 interposed, and clamped from both sides by a clamping means made of iron so that the movable degree of the flexible plate metal became 2 mm at the maximum, to assemble a bipolar type ion exchange membrane electrolytic cell. The spacing between the membrane and the cathode plate was maintained to be 0.5 mm by spacers made of PTFE. For the cation exchange membranes, Flemion F893 (registered trademark of Asahi Glass Company, Limited) was used.

Into the anode compartments, an aqueous sodium chloride solution of 300 g/l was supplied from a lower portion of the compartment frames, so that the sodium chloride concentration at the outlet became about 210 g/l, and into the cathode compartments, a dilute sodium hydroxide aqueous solution was supplied from a lower portion of the compartment frames, so that the concentration of the sodium hydroxide aqueous solution at the outlet became 32 wt %.

Electrolysis tests were carried out at an electrolytic temperature of 90° C. under a current density of 6 kA/m$^2$. As a result, the electrolysis voltage was 3.16 V, and the current efficiency was 96.3%. After the operation for 150 days, the electrolytic cell was disassembled, whereby no abnormality was observed.

EXAMPLE 3

The anode plate, the cathode plate and the partition structure were the same as used in Example 1. In the cathode compartment, molded M-type electric current supply ribs 120 made of nickel were attached to the back plate by welding in the height direction of the compartment frame, as shown in FIG. 6. The M-type electric current supply ribs 120 used, were those having a plate thickness of 1.0 mm, a width A4 of 60 mm and a distance A3 from the back plate to the forward ends of the shoulder portions 123 being 30 mm, and 12 such ribs were disposed with an equal spacing in the electrolysis area. On the other hand, both ends of a flexible plate metal 103 were fixed, respectively, to the forward ends of the opposing shoulder portions 123 of the adjacent M-type electric current supply ribs. As the flexible plate metal 103, the same one as used in Example 1, was employed, and the apex p of the protrusion 109 was fixed and connected as a connecting portion 105 to the cathode plate by welding. Further, in the same manner as in Example 2, spacers 201 were disposed between the membrane and the cathode plate. The spacers used, were the same 15 as used in Example 2.

Further, in the anode compartment, molded M-type electric current supply ribs 130 made of titanium were fixed to the back plate 99 by welding in the height direction of the compartment frame so as to face the electric current supply ribs 120 of the cathode. The M-type electric current supply ribs 130 used, were those having a plate thickness of 2.0 mm, a width of 60 mm and a distance from the back plate to the forward ends of the shoulder portions 133 being 35 mm, and they were welded and fixed to the anode plate 97 at the forward ends of such shoulder portions 133.

Compartment frame units each comprising such an anode compartment and a cathode compartment, and cation exchange membranes, were alternately arranged with a gasket 12 interposed, and clamped from both sides by a clamping means made of iron so that the movable degree of the flexible plate metal became 3 mm at the maximum, to assemble a bipolar type ion exchange membrane electrolytic cell. Further, the spacing between the membrane and the cathode plate was maintained to be 0.5 mm by PTFE spacers, in the same manner as in Example 2.

Into the anode compartments, an aqueous sodium chloride solution of 300 g/l was supplied from a lower portion of the compartment frames, so that the sodium chloride concentration at the outlet became 210 g/l, and into the cathode compartments, a dilute sodium hydroxide aqueous solution was supplied from a lower portion of the compartment frames, so that the concentration of the sodium hydroxide aqueous solution at the outlet became 32 wt %.

Electrolysis tests were carried out at an electrolytic temperature of 90° C. under a current density of 6 kA/m$^2$. As a result, the electrolysis voltage was 3.16 V, and the current efficiency was 96.3%. After the operation for 150 days, the electrolytic cell was disassembled, whereby no abnormality was observed.

Comparative Example 1

An electrolytic cell was constructed in the same manner as in Example 1 except that the cathode plate was attached directly to the cathode ribs without using a flexible plate metal, and the spacing between the membrane and the cathode plate was changed to 2.5 mm. Using this electrolytic cell, electrolysis of sodium chloride was carried out under the same conditions as in Example 1, whereby the electrolysis voltage was 3.39 V, and the current efficiency was 96.2%.

INDUSTRIAL APPLICABILITY

According to the present invention, the cathode supporting members in the cathode compartment are constituted by electric current supply rib base portions and a flexible plate metal or the like supported by such base portions, whereby shortening of the distance between the anode and the cathode has been realized by a safe and simple method, and it is thereby possible to substantially reduce the electrolysis voltage while avoiding a danger of damage to the membrane.

According to the present invention, it is possible to provide a bipolar type ion exchange membrane electrolytic cell which can be operated constantly even at a high electrolytic current density of at least 4 kA/m$^2$ and which provides a high current efficiency and a low electrolysis voltage which can effectively be applied for e.g. production of an aqueous alkali metal hydroxide solution.

What is claimed is:

1. A bipolar ion exchange membrane electrolytic cell comprising an anode compartment frame which comprises an anode plate and an anode back plate arranged substantially parallel with each other with a space therebetween, conductive anode supporting members arranged with a prescribed spacing from one another between the anode plate and the anode back plate, and a cathode compartment frame which comprises a cathode plate and a cathode back plate arranged substantially parallel with each other with a space therebetween, and conductive cathode supporting members arranged with a prescribed spacing from one another between the cathode plate and the cathode back plate, so that the respective back plates are connected back to back to form a compartment frame unit, a plurality of such compartment frame units being arranged with a cation exchange membrane interposed, wherein (a) at least the cathode supporting members comprise electric current supply rib base portions fixed to the cathode back plate and extending up towards the cathode plate, and a flexible member supported by the adjacent electric current supply rib base portions and extending to reach the cathode plate, wherein the electric current supply rib base portions, flexible member, and cathode back plate define a closed space which does not contain the cathode plate, (b) the flexible member and the cathode plate are electrically connected to each other via a connecting portion of the flexible member, and (c) electric current supply from the cathode plate to the electric current supply rib base portions is carried out through the connecting portion, and the cathode plate is movably supported by the function of the flexible member.

2. The bipolar ion exchange membrane electrolytic cell according to claim 1, wherein the flexible member is made of a flexible plate metal, at least one protrusion is formed at substantially the center thereof, and the apex of the protrusion constitutes the connecting portion.

3. The bipolar ion exchange membrane electrolytic cell according to claim 2, wherein the flexible plate metal has a thickness of from 0.1 to 1.0 mm and a width of from 4 to 25 cm, and the spacing between the cathode plate and a portion of the plate metal other than the protrusion is from 3 to 30 mm.

4. The bipolar ion exchange membrane electrolytic cell according to claim 2, wherein the connection between the cathode plate and the connecting portion at the apex of the protrusion is carried out via a plate metal chip inserted between the two.

5. The bipolar ion exchange membrane electrolytic cell of claim 4, wherein the plate metal chip comprises a metal selected from the group consisting of soft stainless steel, nickel, and copper.

6. The bipolar ion exchange membrane electrolytic cell of claim 4, wherein the plate metal chip has a thickness of 0.5 to 3.0 mm, and a width of 3 to 15 mm.

7. The bipolar ion exchange membrane electrolytic cell according to claim 2, wherein the movable degree of the cathode plate is at most 10 mm.

8. The bipolar ion exchange membrane electrolytic cell according to claim 2, wherein the elastic force of the flexible plate metal is represented by the formula (1) and K is within a range of from 0.2 to 200:

$$\delta(\text{mm})=K\times P(\text{kg/cm}^2) \quad (1)$$

where δ is the movable degree (mm) of the flexible plate metal, K is a constant determined by the material and the shape of the metal, and P is the pressure ($kg/cm^2$) exerted to the protrusion of the flexible plate metal.

9. The bipolar ion exchange membrane electrolytic cell according to claim 2, wherein a non-conductive spacer is disposed between the cathode plate and the cation exchange membrane, so that the cathode plate and the cation exchange membrane do not contact directly each other.

10. The bipolar ion exchange membrane electrolytic cell according to claim 9, wherein the spacer has a hardness of from D40 to D80 (D scale test method according to ASTM D2240).

11. The bipolar ion exchange membrane electrolytic cell of claim 9, wherein the non-conductive spacer comprises a non-conductive resin, a non-conductive rubber, or a non-conductive elastomer.

12. The bipolar ion exchange membrane electrolytic cell of claim 11, wherein the non-conductive spacer is porous or foamed.

13. The bipolar ion exchange membrane electrolytic cell of claim 11, wherein the non-conductive spacer comprises a material selected from the group consisting of polytetrafluoroethylene, butyl rubber, and ethylene-propylene-diene rubber.

14. The bipolar type ion exchange membrane electrolytic cell according to claim 2, wherein the spacing between the cathode plate and the cation exchange membrane is from 0.1 to 1.0 mm.

15. The bipolar ion exchange membrane electrolytic cell according to claim 1, wherein the spacing between the cathode plate and the cation exchange membrane is from 0.1 to 1.0 mm.

16. The bipolar ion exchange membrane electrolytic cell of claim 1, wherein the flexible member is a metal selected from the group consisting of soft steel, stainless steel, nickel, nickel alloys, copper, and copper alloys.

17. The bipolar ion exchange membrane electrolytic cell of claim 1, wherein the flexible members extend substantially over the entire area of the cathode compartment.

18. A bipolar ion exchange membrane electrolytic cell comprising an anode compartment frame which comprises an anode plate and an anode back plate arranged substantially parallel with each other with a space therebetween, conductive anode supporting members arranged with a prescribed spacing from one another between the anode plate and the anode back plate, and a cathode compartment frame which comprises a cathode plate and a cathode back plate arranged substantially parallel with each other with a space therebetween, and conductive cathode supporting members arranged with a prescribed spacing from one another between the cathode plate and the cathode back plate, so that the respective back plates are connected back to back to form a compartment frame unit, a plurality of such compartment frame units being arranged with a cation exchange membrane interposed, wherein (a) at least the anode supporting members comprise electric current supply rib base portions fixed to the anode back plate and extending up towards the anode plate, and a flexible member supported by the adjacent electric current supply rib base portions and extending to reach the anode plate wherein the electric current supply rib base portions, flexible member, and anode back plate define a closed space which does not contain the cathode plate, (b) the flexible member and the anode plate are electrically connected to each other via a connecting portion of the flexible member, and (c) electric current supply from the electric current supply rib base portions to the anode is carried out through the connecting portion, and the anode plate is movably supported by the function of the flexible member.

* * * * *